US008739332B2

(12) United States Patent
Hutchison

(10) Patent No.: US 8,739,332 B2
(45) Date of Patent: Jun. 3, 2014

(54) FOOTBOARD WITH LINEN HOLDER AND TRANSPORT SHELF

(75) Inventor: Stephen E. Hutchison, Batesville, IN (US)

(73) Assignee: Hill-Rom Services, Inc., Batesville, IN (US)

( * ) Notice: Subject to any disclaimer, the term of this patent is extended or adjusted under 35 U.S.C. 154(b) by 101 days.

(21) Appl. No.: 13/355,658

(22) Filed: Jan. 23, 2012

(65) Prior Publication Data

US 2012/0198615 A1 Aug. 9, 2012

Related U.S. Application Data

(60) Provisional application No. 61/440,477, filed on Feb. 8, 2011.

(51) Int. Cl.
*A47C 19/00* (2006.01)
*A47C 23/00* (2006.01)

(52) U.S. Cl.
USPC ..... 5/279.1; 5/495; 5/504; 108/6; 108/59

(58) Field of Classification Search
USPC ..... 5/279.1, 495, 488, 498, 504.1, 663, 5/81.1 HS, 81.1 C, 88.1; 108/6, 59, 115
See application file for complete search history.

(56) References Cited

U.S. PATENT DOCUMENTS

| | | | | |
|---|---|---|---|---|
| 541,339 | A | 6/1895 | Thompson | |
| 713,529 | A | 11/1902 | Swindell, Sr. | |
| 1,347,271 | A | 6/1920 | Hartman | |
| 1,359,623 | A | 11/1920 | Sadlick | |
| 1,694,095 | A | 12/1928 | Du Moulin | |
| 1,719,614 | A | 8/1929 | McIntosh | |
| 2,483,920 | A | 10/1949 | McLean et al. | |
| 2,594,926 | A | 4/1952 | Hoffman | |
| 2,701,374 | A | 2/1955 | Hillenbrand et al. | |
| 2,709,818 | A | 6/1955 | Freese | |
| 2,732,568 | A | 1/1956 | Kirkwood, Jr. | |
| 2,739,319 | A | 3/1956 | Keller | |
| 2,750,605 | A | 6/1956 | Blevins | |
| 3,195,151 | A * | 7/1965 | Boyer | 5/624 |

(Continued)

FOREIGN PATENT DOCUMENTS

| | | |
|---|---|---|
| CH | 477876 | 10/1969 |
| EP | 324237 | 7/1989 |

(Continued)

OTHER PUBLICATIONS

European Search Report for EP 12 15 2620, dated Oct. 31, 2012, 4 pages.

*Primary Examiner* — Peter M Cuomo
*Assistant Examiner* — Brittany Wilson
(74) *Attorney, Agent, or Firm* — Barnes & Thornburg LLP

(57) ABSTRACT

A footboard includes a main body and first and second shelves coupled to the main body. The first shelf is pivotable relative to the main body about a substantially horizontal first axis through a first angle of about 270° between a first storage position and a first use position. The second shelf is pivotable relative to the main body about a substantially horizontal second axis through a second angle of about 90° between a second storage position and a second use position. The main body of the footboard has a recess in which the first and second shelves are situated when the respective storage positions.

15 Claims, 8 Drawing Sheets

(56) References Cited

U.S. PATENT DOCUMENTS

| | | | |
|---|---|---|---|
| 3,465,373 | A | 9/1969 | Wilson |
| 3,564,627 | A | 2/1971 | Allard et al. |
| 3,866,251 | A | 2/1975 | Pounds |
| 3,893,197 | A | 7/1975 | Ricke |
| 4,381,572 | A | 5/1983 | Thumberger |
| 4,404,698 | A | 9/1983 | Koncelik et al. |
| 4,724,555 | A | 2/1988 | Poehner et al. |
| 5,279,010 | A | 1/1994 | Ferrand et al. |
| 5,425,148 | A | 6/1995 | Ashcraft et al. |
| 2003/0145381 | A1 | 8/2003 | Higdon et al. |
| 2004/0139546 | A1 * | 7/2004 | Ferrand et al. ..... 5/425 |
| 2008/0128571 | A1 | 6/2008 | Dostaler et al. |

FOREIGN PATENT DOCUMENTS

| | | | |
|---|---|---|---|
| EP | 0 656 183 | A2 | 6/1995 |
| FR | 659 792 | A | 7/1929 |
| FR | 700055 | | 2/1931 |
| FR | 811006 | | 4/1937 |
| GB | 737188 | | 9/1955 |
| WO | WO 01/86575 | A2 | 11/2001 |

* cited by examiner

FOOTBOARD WITH LINEN HOLDER AND TRANSPORT SHELF

CROSS REFERENCE TO RELATED APPLICATIONS

The present application claims the benefit, under 35 U.S.C. §119(e), of U.S. Provisional Application No. 61/440,477 which was filed Feb. 8, 2011 and which is hereby incorporated by reference herein.

BACKGROUND

The present disclosure relates to footboards of patient support apparatuses, such as hospital beds. More particularly, the present disclosure relates to footboards that include a linen holder and/or a transport shelf.

Footboards of some hospital beds are movable, or have portions that are movable, to one or more positions to serve as a shelf that supports patient care equipment above the feet of a patient lying on the bed. See, for example, U.S. Pat. No. 4,724,555 in which the entire footboard becomes a shelf and see U.S. Pat. No. 5,525,148 in which a portion of the footboard detaches from a storage area and reattaches to the footboard to form a shelf. Beds having linen holders that hold folded sheets at the end of the bed prior to use of the sheets are also known.

SUMMARY

A footboard for a patient support apparatus, or a patient support apparatus having such a footboard, has one or more of the features recited in the appended claims and/or the following features which, alone or in any combination, may comprise patentable subject matter:

The footboard may comprise a main body and first and second shelves coupled to the main body. The first shelf may be pivotable relative to the main body about a substantially horizontal first axis through a first angle of about 270° between a first storage position and a first use position. The second shelf may be pivotable relative to the main body about a substantially horizontal second axis through a second angle of about 90° between a second storage position and a second use position.

In some embodiments, the first axis may be situated adjacent an upper end of the main body and the second axis may be situated adjacent a lower end of the main body. The first and second shelves may extend from the main body in opposite directions when in the respective first and second use positions. The first shelf may be substantially parallel with the second shelf and with the main body when the first and second shelves are in the respective first and second storage positions.

According to this disclosure, the main body may include a recess in which the first and second shelves are situated when in the respective first and second storage positions. The recess of the main body may comprise a stepped recess including a deep portion and a shallow portion. The second shelf may occupy a first part of the deep portion of the recess when in the second storage position. The first shelf may occupy the shallow portion and a second part of the deep portion when in the first storage position. Thus, the second shelf may be sandwiched between the first shelf and the main body when the first and second shelves are in the respective first and second storage positions. So, in some embodiments, the first shelf blocks the second shelf from view when the first and second shelves are in the respective first and second storage positions.

The main body may have side portions on opposite sides of the recess and the first and second shelves may be located between the side portions when in the respective first and second storage positions. The main body may have a thick wall interconnecting the side portions and defining part of the shallow portion of the recess. The main body may also have a thin wall interconnecting the side portions and defining part of the deep portion of the recess. The thick wall may be located above the thin wall. In some embodiments, the side portions, the thick wall, and the thin wall are formed integrally with each other. In other embodiments, the side portions, the thick wall, and the thin wall may be separate pieces that couple together. An internal metal frame may be included in the footboard in some embodiments. In such embodiments, the side portions, thick wall, and thin wall may include plastic molded cosmetic covers that cover the internal metal frame.

The main body may include a protrusion that serves as a stop which prevents the first shelf from pivoting relative to the main body past the use position. The protrusion may be located near a top of the main body. The first shelf may be returnable to the first storage position while the second shelf remains in the second use position. In such a configuration, the second shelf projects outwardly from beneath an end edge of the first shelf when the first shelf is in the storage position and the second shelf is in the use position.

It is contemplated by this disclosure that the first shelf serves as a transport shelf and the second shelf serves as a linen holder when the first and second shelves are in the respective first and second use positions. This is not to imply however, that linens could not be placed on the first shelf and/or that patient care equipment could not be placed on the second shelf, if desired. The patient care equipment typically supported on the first shelf includes heart rate monitors, EKG equipment, pulse oximetry monitors, infusion pumps, and the like.

Additional features, which alone or in combination with any other feature(s), such as those listed above and those listed in the claims, may comprise patentable subject matter and will become apparent to those skilled in the art upon consideration of the following detailed description of various embodiments exemplifying the best mode of carrying out the embodiments as presently perceived.

BRIEF DESCRIPTION OF THE DRAWINGS

The detailed description particularly refers to the accompanying figures, in which.

DETAILED DESCRIPTION

Figure 1:
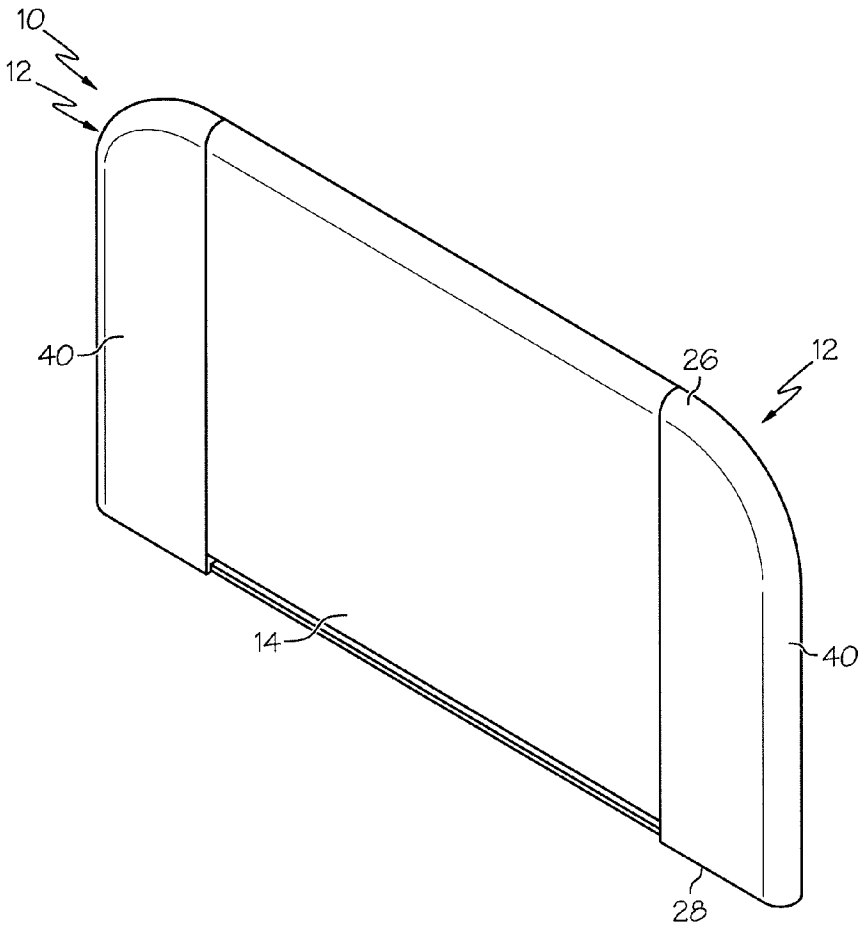
FIG. 1 is a perspective view of a footboard showing a substantially rectangular first shelf in a storage position between two side portions of the footboard.
Figure 2:
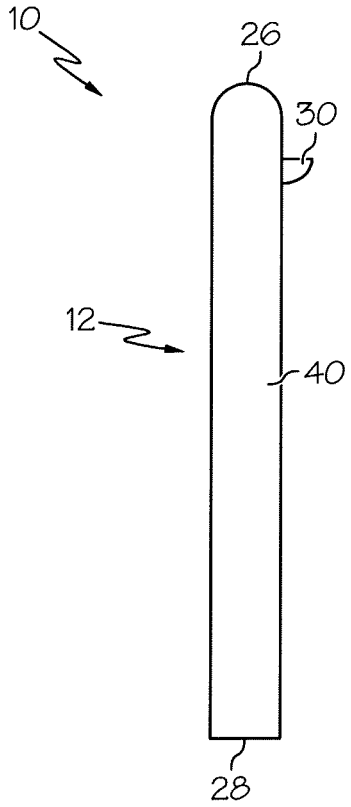
FIG. 2 is a side elevation view of the footboard of FIG. 1.

A footboard 10 for a patient support apparatus, such as a hospital bed (not shown), has a main body 12 and first and second shelves 14, 16 coupled to the main body 12 as shown in FIGS. 1-4. First shelf 14 is pivotable relative to main body 12 about a substantially horizontal first axis 18, shown in FIGS. 3 and 4, through a first angle 20, shown in FIG. 4, of about 270° between a first storage position and a first use position. Second shelf 16 is pivotable relative to main body 12 about a substantially horizontal second axis 22, shown in FIGS. 3 and 4, through a second angle 24, shown in FIG. 4, of about 90° between a second storage position and a second use position.

Figure 3:
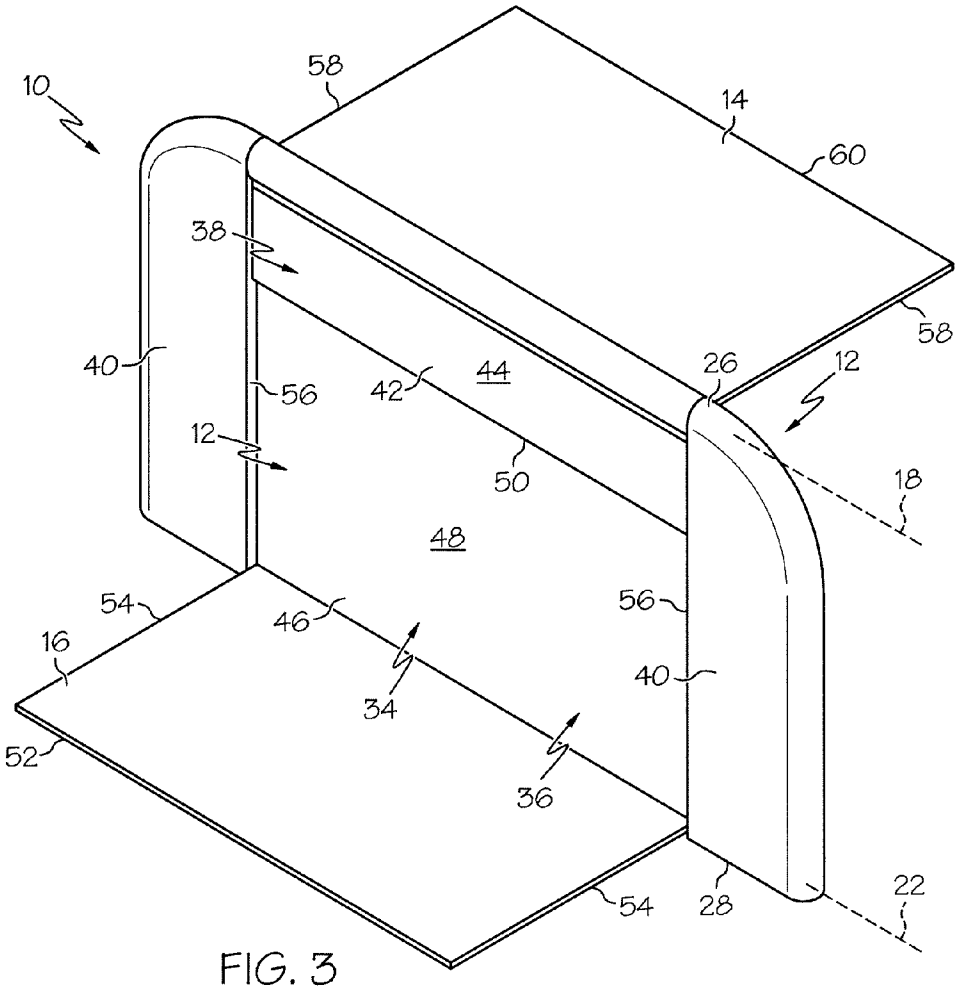
FIG. 3 is a perspective view of the footboard showing the first shelf moved to a use position extending in a first direction from an upper end of a main body of the footboard and showing a second shelf moved to a use position extending in a second direction, opposite the first direction, from a lower end of the main body of the footboard.
Figure 4:
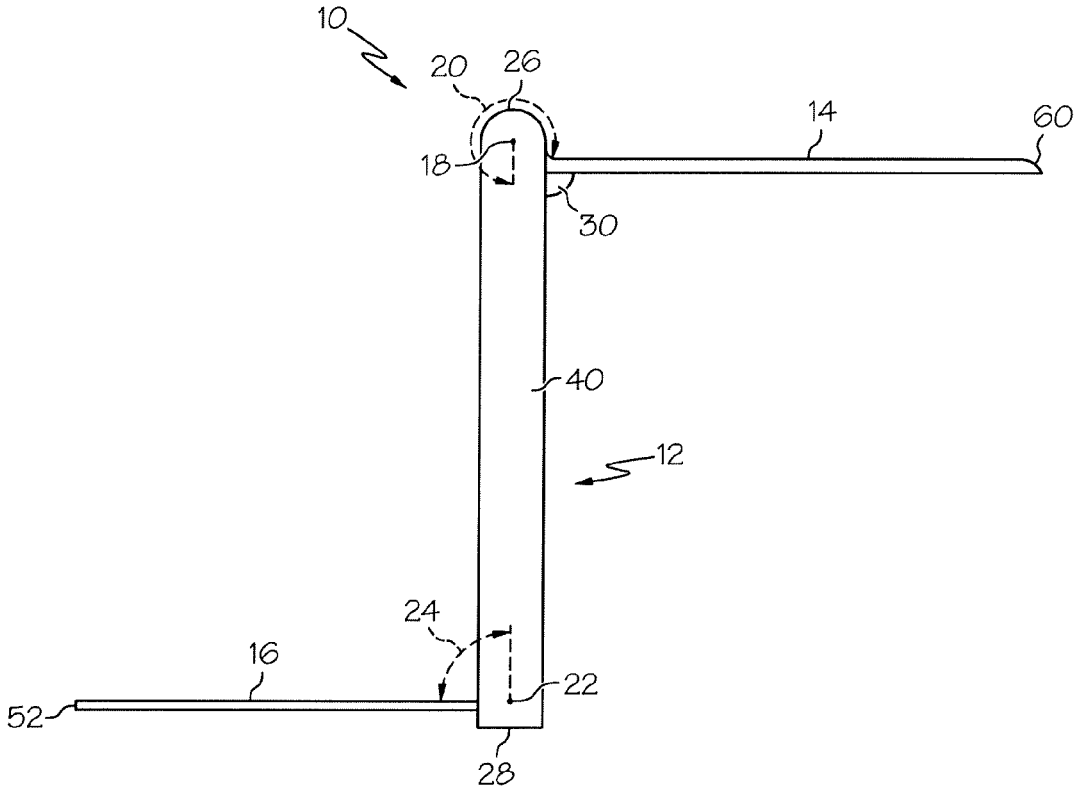
FIG. 4 is a side elevation view of the footboard of FIG. 3 showing the first and second shelves in the respective use positions.

First axis 18 is situated adjacent an upper end 26 of main body 12 and second axis 22 is situated adjacent a lower end 28 of main body 12. Thus, first shelf 14 is pivoted upwardly out of the storage position and then flipped up and over the top 26 of main body 12 to reach the use position. A protrusion 30 extends from main body 12 near upper end 12 and acts as a stop to prevent first shelf 14 from pivoting past its use position. First shelf 14, therefore, is supported in a horizontal orientation by protrusion 30 when in the use position. In contrast, second shelf 16 is pivoted downwardly out of its storage position to reach its use position. A bottom ridge 32, shown in FIG. 7, of main body 12 acts as a stop to prevent second shelf 16 from pivoting past its use position. Each of shelves 14, 16 extend horizontally from main body 12 when in the respective use positions. However, shelves 14, 16 extend from main body 12 in opposite directions when in the respective use positions as shown in FIGS. 3 and 4.

Figure 7:
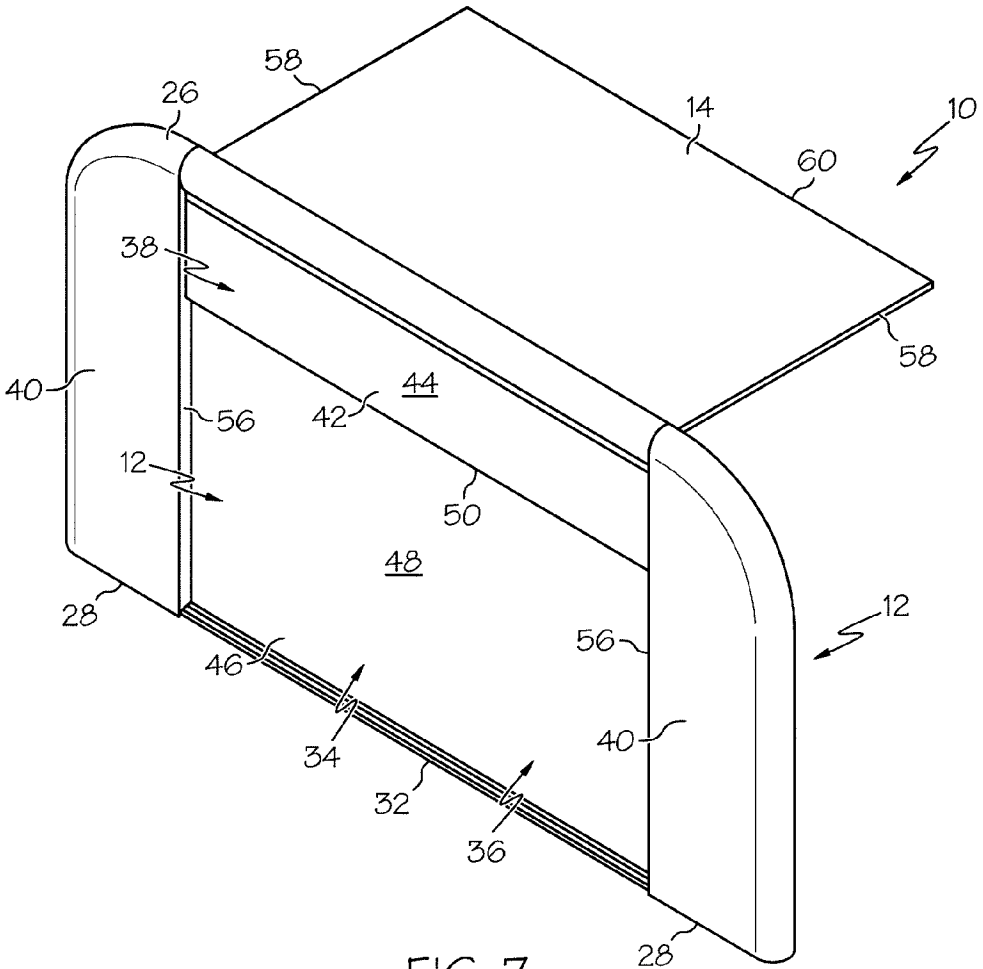
FIG. 7 is perspective view of the footboard showing the second shelf omitted and showing the first shelf in its use position.
Figure 8:
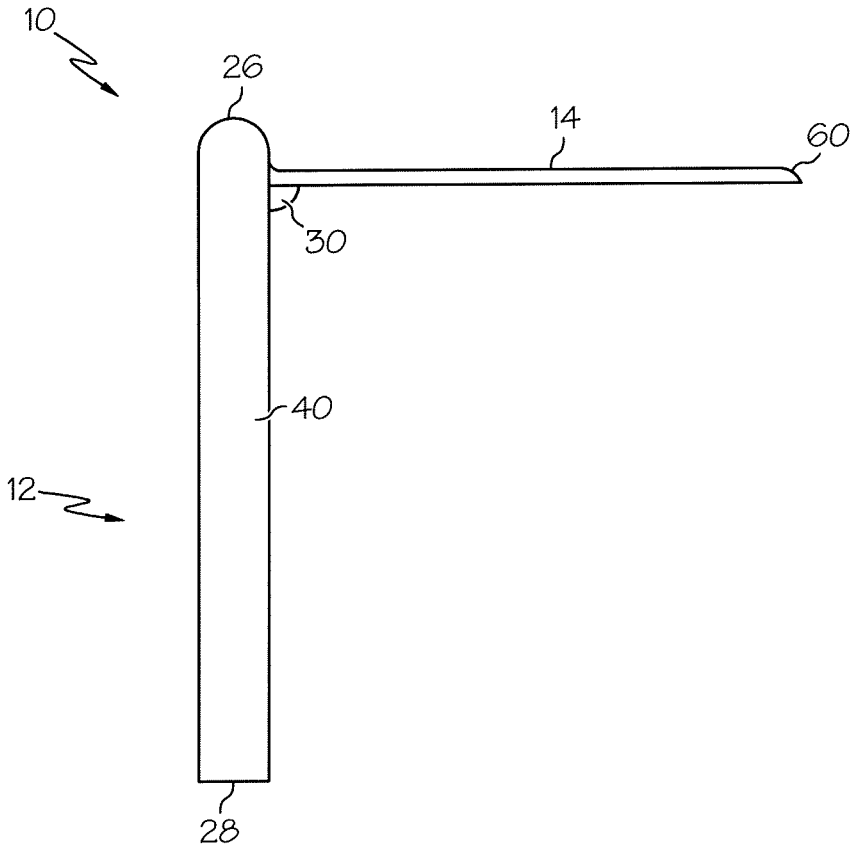
FIG. 8 is a side elevation view of the footboard of FIG. 7 showing the first shelf in its use position.

Main body 12 includes a recess 34 in which the first and second shelves 14, 16 are situated when in the respective storage positions. In the illustrative embodiment, recess 34 of the main body 12 is a stepped recess including a deep portion 36 and a shallow portion 38 as shown in FIGS. 3 and 7. Second shelf 16 occupies a first part of the deep portion 36 of the recess 34 when in its storage position. First shelf 14 occupies the shallow portion 38 and a second part of the deep portion 36 when in its storage position. Because the first and second shelves 14, 16 are substantially flat, panel-like elements, the first shelf 14 is substantially parallel with second shelf 16 and with main body 12 when the first and second shelves 14, 16 are in the respective storage positions. Based on the foregoing, it will be appreciated that second shelf 16 is sandwiched between the first shelf 14 and the main body 12 when first and second shelves 14, 16 are in the respective storage positions. So, in the illustrative embodiment, first shelf 14 blocks the second shelf 16 from view when the first and second shelves 14, 16 are in the respective storage positions as shown in FIG. 1.

Main body 12 has side portions 40 on opposite sides of the recess 34 and first and second shelves 14, 16 are located between side portions 40 when in the respective first and second storage positions. Main body 12 has a thick wall 42 that interconnects the side portions 40 and that has a vertical surface 44 defining part of the shallow portion 38 of recess 34 as shown in FIGS. 3 and 7. Main body 12 also has a thin wall 46 that interconnects side portions 40 and that has a vertical surface 48 defining part of the deep portion 36 of recess 34. Thick wall 42 is located above thin wall 46 and a bottom edge 50 of thick wall 42 extends between surfaces 44, 48. When second shelf 16 is in the storage position, an end edge 52 of shelf 16 is situated in confronting relation with edge 50 with a minimal amount (e.g., 0.1 inch to 0.01) therebetween.

The offset distance between surfaces 44, 48 defined by edge 50 is approximately the same as the thickness of second shelf 16, and even slightly greater in some embodiments, so that shelf 16 is able to fit underneath edge 50 of thick wall 42 when shelf 16 is in the storage position. Also, side edges 54 of shelf 16 are situated in confronting relation with opposite edges 56 of side portions 40 of main body 12 with a minimal amount of clearance therebetween when shelf 16 is in the storage position. Side edges 58 of first shelf 14 are also situated in confronting relation with opposite edges 56 of side portions 40 of main body 12 with a minimal amount of clearance therebetween when shelf 14 is in the storage position.

Figure 5:
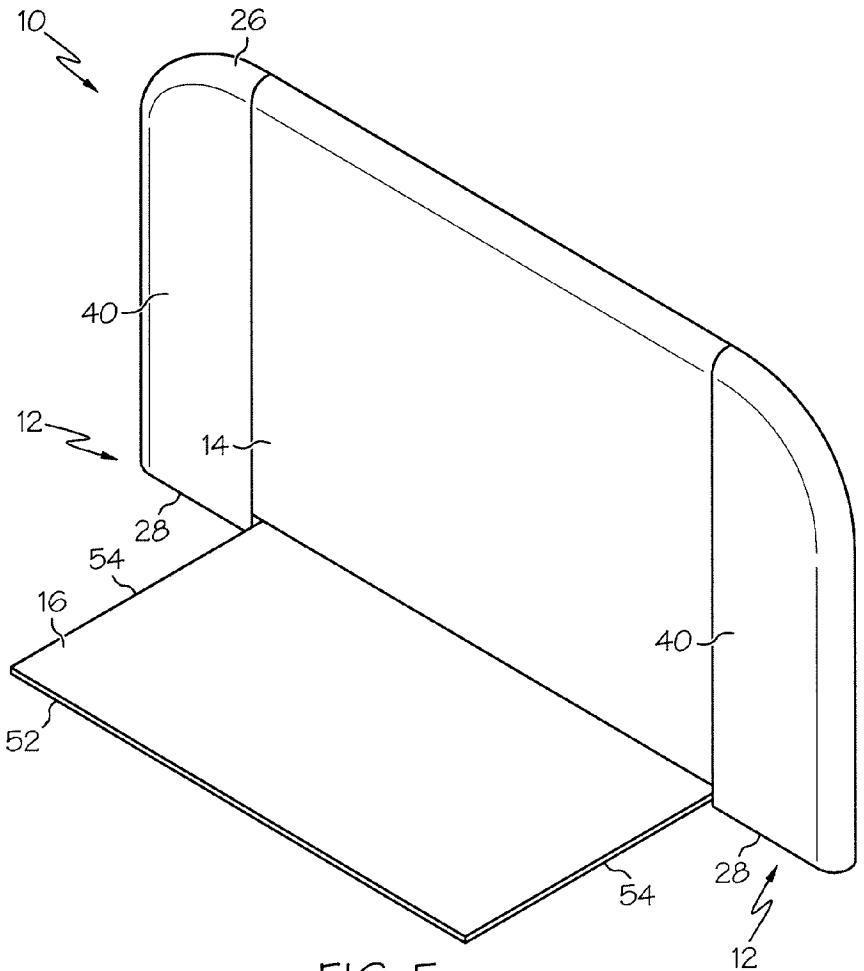
FIG. 5 is a perspective view of the footboard showing the first shelf returned to its storage position while the second shelf remains in its use position.
Figure 6:
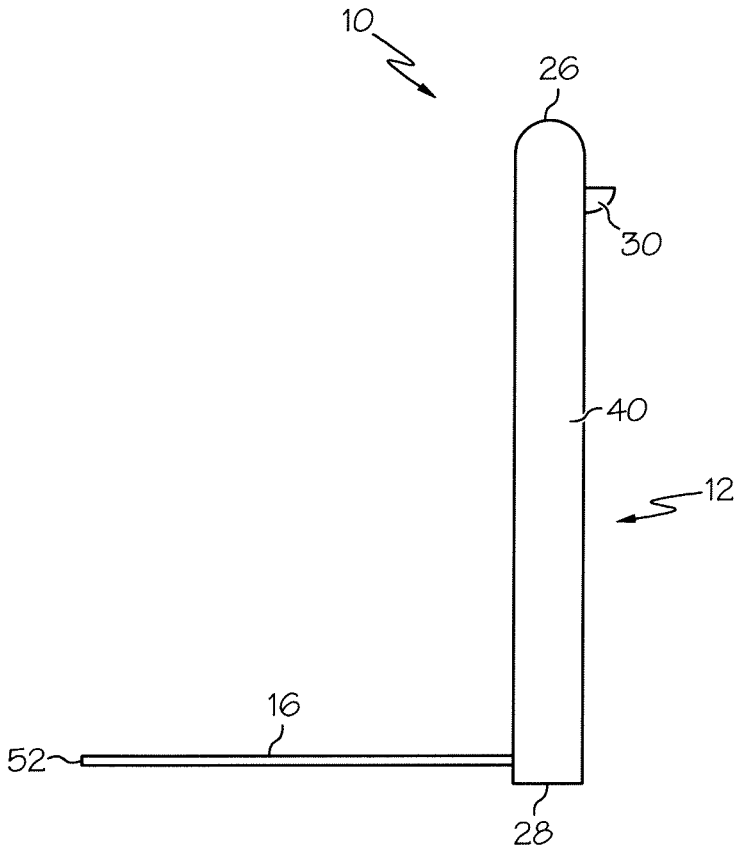
FIG. 6 is a side elevation view of the footboard of FIG. 3 showing the second shelf in its use position.

It will also be noted that an end edge 60 of first shelf 14 is situated in confronting relation with bottom ridge 32 of main body 12, but with a bit more clearance therebetween when first shelf 14 is in the storage position. The additional clearance between end edge 60 and bottom ridge 32 is provided to allow the first shelf 14 to be returned to its storage position while the second shelf 16 remains in its use position as shown in FIGS. 5 and 6. In such a configuration, the second shelf 16 projects outwardly from beneath end edge 60 of first shelf 14 when first shelf 14 is in its storage position and second shelf 16 is in its use position. Thus, the amount of clearance between end edge 60 and bottom ridge 32, when shelf 14 is in the storage positions, is slightly more than the thickness of second shelf 16.

In some embodiments, side portions 40, thick wall 42, and thin wall 46 are formed integrally with each other. In other embodiments, one or more of side portions 40, thick wall 42, and thin wall 46 are separate pieces that couple together. An internal metal frame (not shown) may be included in the footboard 10 in some embodiments. In such embodiments, side portions 40, thick wall 42, and thin wall 46 include plastic molded cosmetic covers that cover the internal metal frame. Also in such embodiments, a portion of the metal frame serves as a pair of couplers, either as connecting posts or connecting sockets, for example, that are located at the bottom of side portions 40 of footboard 10 and that interconnect with mating couplers of a frame (not shown) of the patient support apparatus to which footboard 10 attaches.

As was mentioned previously, it is contemplated by this disclosure that the first shelf 14 serves as a transport shelf for medical equipment and the second shelf 16 serves as a linen holder when the first and second shelves 14, 16 are in the respective first and second use positions. However, linens could be placed on the first shelf 14 and/or patient care equipment could be placed on the second shelf 16, if desired. When footboard 10 is coupled to the frame of a patient support apparatus and first and second shelves 14, 16 are in the use positions, first shelf 14 typically extends forwardly toward the head end of the patient support apparatus so as to overhang the feet of the patient and the second shelf typically extends rearwardly away from the patient support apparatus. The patient care equipment, such as heart rate monitors, EKG equipment, pulse oximetry monitors, infusion pumps, and the like, may be held in place on shelf 14 by straps or other suitable couplers, if desired, so that the equipment is firmly held in place on shelf 14 during transport of the patient support apparatus through a healthcare facility. Optionally, therefore, slots or notches may be provided in shelf 14 in one or more locations to accommodate such straps. Further optionally, retainers such as detents or snap fingers may be provided between main body 12 and shelves 14, 16 to retain shelves 14, 16 in their respective storage positions.

Although certain illustrative embodiments have been described in detail above, many embodiments, variations and modifications are possible that are still within the scope and spirit of this disclosure as described herein and as defined in the following claims.

The invention claimed is:

1. A footboard for a patient support apparatus, the footboard comprising a main body, a first shelf coupled to the main body and pivotable relative to the main body about a substantially horizontal first axis through a first angle of about 270° between a first storage position and a first use position, and a second shelf coupled to the main body and pivotable relative to the main body about a substantially horizontal second axis through a second angle of about 90° between a second storage position and a second use position, wherein the first axis is situated adjacent an upper end of the main body and the second axis is situated adjacent a lower end of the main body.

2. The footboard of claim 1, wherein the first and second shelves extend from the main body in opposite directions when in the respective first and second use positions.

3. The footboard of claim 2, wherein the first shelf is substantially parallel with the second shelf and with the main body when the first and second shelves are in the respective first and second storage positions.

4. The footboard of claim 1, wherein the main body includes a recess in which the first and second shelves are situated when in the respective first and second storage positions.

5. The footboard of claim 4, wherein the main body has side portions on opposite sides of the recess and the first and second shelves are located between the side portions when in the respective first and second storage positions.

6. The footboard of claim 5, wherein the main body has a thick wall interconnecting the side portions and defining part of the shallow portion of the recess and wherein the main body has a thin wall interconnecting the side portions and defining part of the deep portion of the recess.

7. The footboard of claim 6, wherein the thick wall is located above the thin wall.

8. The footboard of claim 6, wherein the side portions, the thick wall, and the thin wall are formed integrally with each other.

9. The footboard of claim 1, wherein the main body includes a protrusion that serves as a stop which prevents the first shelf from pivoting relative to the main body past the use position.

10. The footboard of claim 9, wherein the protrusion is located near a top of the main body.

11. The footboard of claim 1, wherein the first shelf is returnable to the first storage position while the second shelf remains in the second use position.

12. A footboard for a patient support apparatus, the footboard comprising a main body, a first shelf coupled to the main body and pivotable relative to the main body about a substantially horizontal first axis through a first angle of about 270° between a first storage position and a first use position, and a second shelf coupled to the main body and pivotable relative to the main body about a substantially horizontal second axis through a second angle of about 90° between a second storage position and a second use position, wherein the main body includes a recess in which the first and second shelves are situated when in the respective first and second storage positions, wherein the recess of the main body comprises a stepped recess including a deep portion and a shallow portion, the second shelf occupies a first part of the deep portion of the recess when in the second storage position, and the first shelf occupies the shallow portion and a second part of the deep portion when in the first storage position.

13. A footboard for a patient support apparatus, the footboard comprising a main body, a first shelf coupled to the main body and pivotable relative to the main body about a substantially horizontal first axis through a first angle of about 270° between a first storage position and a first use position, and a second shelf coupled to the main body and pivotable relative to the main body about a substantially horizontal second axis through a second angle of about 90° between a second storage position and a second use position, wherein the main body includes a recess in which the first and second shelves are situated when in the respective first and second storage positions, wherein the second shelf is sandwiched between the first shelf and the main body when the first and second shelves are in the respective first and second storage positions.

14. A footboard for a patient support apparatus, the footboard comprising a main body, a first shelf coupled to the main body and pivotable relative to the main body about a substantially horizontal first axis through a first angle of about 270° between a first storage position and a first use position, and a second shelf coupled to the main body and pivotable relative to the main body about a substantially horizontal second axis through a second angle of about 90° between a second storage position and a second use position, wherein the main body includes a recess in which the first and second shelves are situated when in the respective first and second storage positions, wherein the first shelf blocks the second shelf from view when the first and second shelves are in the respective first and second storage positions.

15. A footboard for a patient support apparatus, the footboard comprising a main body, a first shelf coupled to the main body and pivotable relative to the main body about a substantially horizontal first axis through a first angle of about 270° between a first storage position and a first use position, and a second shelf coupled to the main body and pivotable relative to the main body about a substantially horizontal second axis through a second angle of about 90° between a second storage position and a second use position, wherein the first shelf is returnable to the first storage position while the second shelf remains in the second use position, wherein the second shelf projects outwardly from beneath an end edge of the first shelf when the first shelf is in the storage position and the second shelf is in the use position.

* * * * *